US010861467B2

(12) United States Patent
Torres et al.

(10) Patent No.: US 10,861,467 B2
(45) Date of Patent: Dec. 8, 2020

(54) AUDIO PROCESSING IN ADAPTIVE INTERMEDIATE SPATIAL FORMAT

(71) Applicant: Dolby Laboratories Licensing Corporation, San Francisco, CA (US)

(72) Inventors: Juan Felix Torres, Darlinghurst (AU); David S. Mcgrath, Rose Bay (AU); Michael William Mason, Wahroonga (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 92 days.

(21) Appl. No.: 15/902,608

(22) Filed: Feb. 22, 2018

(65) Prior Publication Data

US 2018/0254047 A1 Sep. 6, 2018

Related U.S. Application Data

(60) Provisional application No. 62/465,531, filed on Mar. 1, 2017.

(51) Int. Cl.
*G10L 19/008* (2013.01)
*H04S 5/00* (2006.01)

(52) U.S. Cl.
CPC ..... *G10L 19/008* (2013.01); *H04S 5/005* (2013.01); *H04S 2400/11* (2013.01)

(58) Field of Classification Search
CPC ..... H04R 1/406; H04R 2201/405; H04R 2499/15; H04R 29/005; H04R 5/027;
(Continued)

(56) References Cited

U.S. PATENT DOCUMENTS 9,807,538 B2 10/2017 McGrath
2002/0172370 A1* 11/2002 Ito ..... H04S 3/00 381/18

(Continued)

FOREIGN PATENT DOCUMENTS

EP 2637427 9/2013
WO 2008/046530 4/2008

(Continued)

OTHER PUBLICATIONS

Cheng, E. et al "Spatialized Teleconferencing: Recording and "Squeezed" Rendering of Multiple Distributed Sites" IEEE Telecommunication Networks and Applications Conference, Dec. 7, 2008, pp. 411-416.

(Continued)

*Primary Examiner* — Bharatkumar S Shah

(57) ABSTRACT

Systems, methods, and computer program products of audio processing based on Adaptive Intermediate Spatial Format (AISF) are described. The AISF is an extension to ISF that allows spatial resolution around an ISF ring to be adjusted dynamically with respect to content of incoming audio objects. An AISF encoder device adaptively warps each ISF ring during ISF encoding to adjust angular distance between objects, resulting in increase in uniformity of energy distribution around the ISF ring. At an AISF decoder device, matrices that decode sound positions to the output speaker take into account the warping that was performed at the AISF encoder device to reproduce the true positions of sound sources.

15 Claims, 13 Drawing Sheets

(58) Field of Classification Search
CPC ..... H04R 2420/01; H04R 3/04; H04R 5/033; H04R 5/04; H04S 2400/11; H04S 2420/01; H04S 5/005; H04S 7/304; G10L 19/008; G10L 21/02
USPC ..... 704/500
See application file for complete search history.

(56) References Cited

U.S. PATENT DOCUMENTS

| | | | | |
|---|---|---|---|---|
| 2013/0023603 | A1 | 1/2013 | Walter et al. | |
| 2016/0212525 | A1* | 7/2016 | Nakadai | H04R 1/406 |
| 2017/0064484 | A1* | 3/2017 | Borss | H04S 5/005 |
| 2017/0366912 | A1* | 12/2017 | Stein | H04S 7/304 |
| 2020/0172370 | A1* | 6/2020 | Eguchi | B65H 3/063 |

FOREIGN PATENT DOCUMENTS

| | | |
|---|---|---|
| WO | 2011/117399 | 9/2011 |
| WO | 2014/187986 | 11/2014 |
| WO | 2015/054033 | 4/2015 |
| WO | 2015/073454 | 5/2015 |

OTHER PUBLICATIONS

Cheng, B. et al "A Spatial Squeezing Approach to Ambisonic Audio Compression" IEEE International Conference on Acoustics, Speech and Signal Processing, Mar. 31, 2008, pp. 369-372.
Pomberger, H. et al "Warping of 3D Ambisonic Recordings" Ambisonics Symposium Jun. 2-3, 2011, Lexington, KY, pp. 1-11.

* cited by examiner

AUDIO PROCESSING IN ADAPTIVE INTERMEDIATE SPATIAL FORMAT

CROSS-REFERENCE TO RELATED APPLICATIONS

This application claims the benefit of priority from U.S. Provisional Patent Application No. 62/465,531 filed Mar. 1, 2017, which is hereby incorporated by reference in its entirety.

TECHNICAL FIELD

This disclosure relates generally to audio signal processing.

BACKGROUND

Any discussion of the background art throughout the specification should in no way be considered as an admission that such art is widely known or forms part of common general knowledge in the field.

Intermediate Spatial Format (ISF) is a spatial audio processing format that enables representation of a spatial audio scene as a set of channels equally spaced in various angles around one or more concentric rings, referred to as ISF rings, where each ring represents a particular height position in a listening environment. The channels in each ISF ring are configurable, independently from channels in other ISF rings. The channels can be decoded via a mix matrix to an arbitrary set of output speaker angles. The number of output speakers can be greater or lower than the number of channels in each ISF ring. The spatial resolution around an ISF ring is constant and is determined by the number of ISF channels. Quality of playback experience, e.g., how closely decoded sound positions match original sound positions, can be improved by increasing the number of channels in the ISF.

SUMMARY

Techniques for Adaptive Intermediate Spatial Format (AISF) are described. The AISF is an extension to ISF that allows spatial resolution around an ISF ring to be adjusted dynamically with respect to content of incoming audio objects. An AISF encoder device adaptively warps each ISF ring during ISF encoding to adjust angular distance between objects, resulting in increase in uniformity of amplitude distribution around the ISF ring. At an AISF decoder device, matrices that decode sound positions to the output speaker take into account the warping that was performed at the AISF encoder device to reproduce the true positions of sound sources.

The features described in this specification can achieve one or more advantages. For example, AISF can improve quality of playback experience over conventional ISF technology without increasing the number of channels in the ISF. By dynamically moving nearby audio objects away from each other, AISF can achieve variable spatial resolution that adapts optimally to an incoming audio scene. Accordingly, AISF can yield improved spatial clarity compared to conventional ISF at the same bandwidth or achieve similar quality to conventional ISF using fewer ISF channels.

AISF can dynamically switch between formats based on the spatial properties of an audio scene. For example, AISF can use a lower channel count in time intervals where audio objects are few and spread widely apart, thus saving on bandwidth and encode/decode complexity. AISF may improve headphone rendering. A headphone renderer for ISF can place virtual sources at the angles of audio channels in the ISF. In AISF, warping side information can be used to move these channels dynamically over time, thus retaining benefits of object-based virtualization.

The details of one or more implementations of the subject matter are set forth in the accompanying drawings and the description below. Other features, aspects and advantages of the subject matter will become apparent from the description, the drawings and the claims.

BRIEF DESCRIPTION OF THE DRAWINGS

Like reference symbols in the various drawings indicate like elements.

DETAILED DESCRIPTION

AISF Encoding and Decoding

Figure 1:
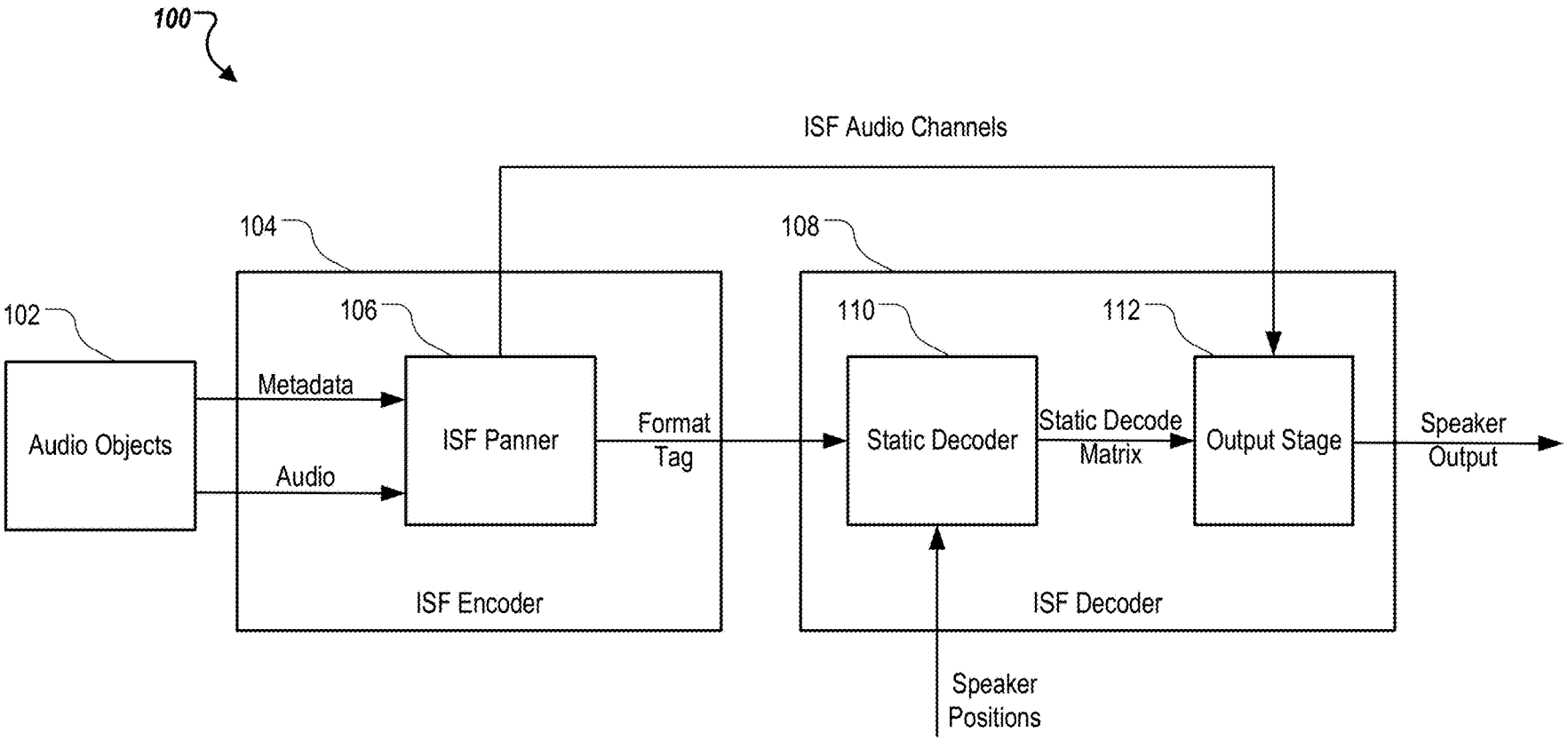
FIG. 1 (Prior Art)
FIG. 1 is a block diagram of an example conventional ISF audio processing system.

FIG. 1 is a block diagram of an example conventional ISF audio processing system 100. The audio processing system 100 is configured to render a spatialized virtual audio source around an expected listener to a series of intermediate virtual speaker channels around the listener. The ISF being implemented can be an alternative representation of an object-based spatial audio scene. It has the advantage over object-based audio by not requiring side-information, while still allowing accurate rendering on different speaker configurations. In addition, the transmitted audio signals behave like conventional surround audio channels, thus allowing ISF audio to be transmitted through legacy audio codecs.

The object-based spatial audio scene can be represented as one or more audio objects 102. An encoder device 104 can determine, e.g., by retrieving, audio data and metadata from the audio objects 102. The audio data can include one or more monophonic objects (e.g., $\text{Object}_i$). The metadata can include a time-varying location (e.g., $\text{XYZ}_i(t)$) of sound sources, where i is an object number and t is time. The encoder device 104 can include an ISF panner 106. The ISF panner 106 is a component device of the encoder device 104 configured to pan the audio objects 102 to a number (N) of ISF audio channels. The output of ISF panner 106 can include ISF signals that include N ISF audio channels. In addition, the ISF signals can include a format tag generated by ISF panner 106 for the ISF audio channels. The format tag can specify a number of ISF channels. Encoder device 104 can provide the ISF signals and the format tag to a decoder device 108.

The decoder device 108 includes static decoder 110 and output stage 112. Static decoder 110 is a component device of decoder device 108 configured to generate a static decode matrix from the format tag and output speaker positions. Output stage 112 receives the signals of the ISF audio channels, decodes the ISF audio channels into speaker channels using the static decode matrix, and generates speaker output by multiplying the ISF audio channels by the static decode matrix. In conventional ISF, spatial resolution of the audio scene is uniform over each ring, and proportional to the number N of ISF audio channels that are transmitted.

Figure 2:
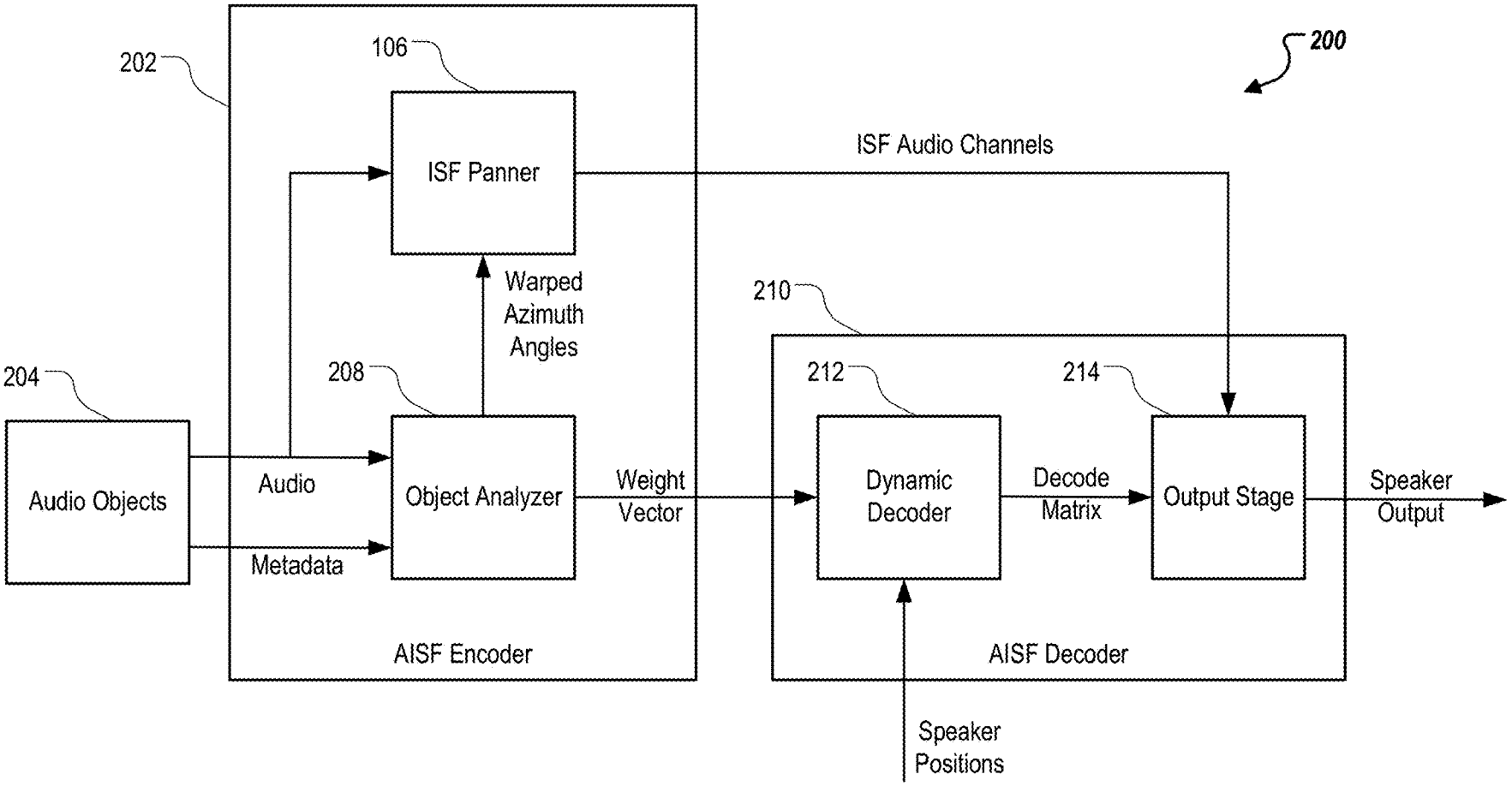
FIG. 2 is a block diagram illustrating an example AISF audio processing system.

FIG. 2 is a block diagram illustrating example AISF audio processing system 200. The AISF audio processing system 200 includes an AISF encoder device 202. The AISF encoder device 202 receives audio objects 204. The audio objects 204 can include audio signals and metadata. The metadata can indicate a respective location of each audio signal. The AISF encoder device 202 includes ISF panner 106. The ISF panner 106 is a component device of AISF encoder device 202 configured to pan audio objects 204 into a number (N) of ISF audio channels as described in reference to FIG. 3.

The AISF encoder device 202 includes an AISF object analyzer 208. The AISF object analyzer 208 is a component device of the AISF encoder device 202 configured to receive audio signals and metadata in the audio objects 204 and compute a measure of audio signal amplitude, or loudness, as a function of azimuth angle and time. From the amplitude measure, the AISF object analyzer 208 computes a time-varying azimuth warping function that moves object locations to dynamically control spatial resolution. The warping operation can include a spatial warping of an azimuth ring in a beehive model as described in reference to FIG. 3. The warping expands spatial regions where the audio signal amplitude, or loudness, is high at the expense of compressing low-amplitude regions.

The ISF panner 106 then encodes the audio signals from the audio objects 204 to generate ISF audio channel signals. The ISF panner 106 then transmits the ISF audio channel signals to an AISF decoder device 210 of the AISF audio processing system 200. The AISF object analyzer 208 transmits the weight vector as side information describing the azimuth warping function.

The AISF decoder device 210 includes a dynamic decoder 212. The dynamic decoder 212 is a component device of the AISF decoder device 210 configured to compute an inverse warping function based on the weight vector received from the AISF object analyzer 208. The dynamic decoder 212 can receive output speaker positions, in terms of azimuth angles. The dynamic decoder 212 then applies the inverse warping function to azimuth angles of output loudspeaker positions. The dynamic decoder 212 feeds the warped speaker positions to an ISF static decoder to generate a decode matrix.

The AISF decoder device 210 includes an output stage 214. The output stage 214 is a device component of the AISF decoder device 210 configured to multiply the decode matrix by the ISF audio channels to generate a loudspeaker audio output. The output stage 214 can submit the loudspeaker audio output to one or more loudspeakers or headphones.

AISF Warping

Figure 3:
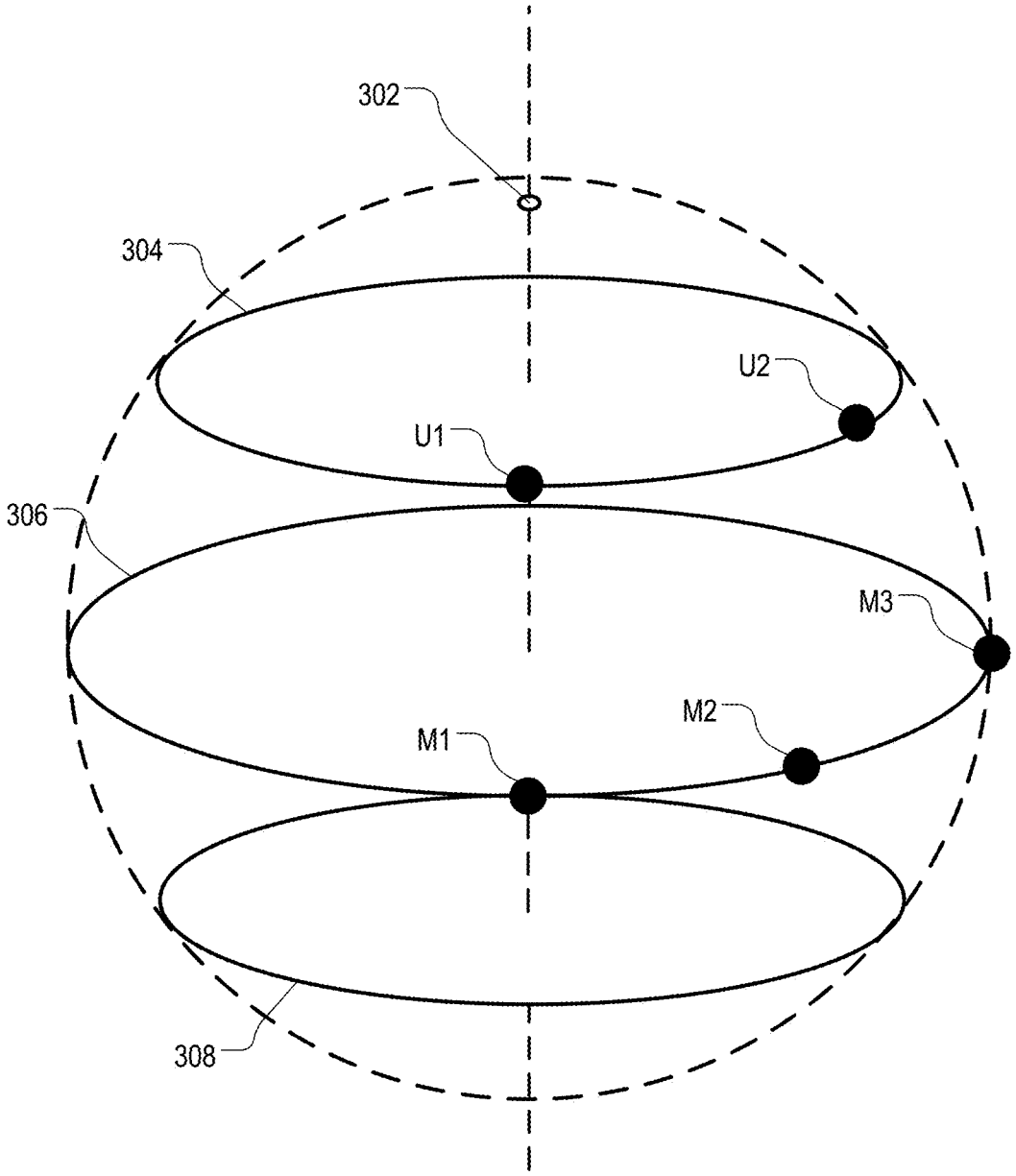
FIG. 3 is a diagram illustrating stacked layers of an example ISF panning space.

FIG. 3 is a diagram illustrating stacked rings of an example ISF panning space. In the example shown, the ISF panning space has multiple ISF rings. The ISF rings include a zenith ring 302, an upper ring 304, a middle ring 306, and a bottom ring 308. Optionally, the ISF panning space can have a nadir ring. Zenith ring 302 and the nadir ring can have zero radius and thus can be points. In various implementations, more or fewer rings are possible. In this specification, for convenience, AISF audio processing is described in reference to a single ring, e.g., the middle ring 306.

A sound field can be represented using audio objects that are located on the rings 302, 304, 306 and 308 on a surface of a sphere centered at a listener. Each ring can be populated by a set of virtual speaker channels, designated as ISF channels, that are uniformly spread around the ring. Hence, the channels in each ring can correspond to specific decoding angles. For example, the middle ring 306 can have N channels. The N channels in the middle ring 306 can be designated as M1, M2, M3 . . . Mn. The ISF channel M1 corresponds to a zero-degree azimuth angle, e.g., directly in front; the ISF channel M2 can be to the left of center at another azimuth angle, from the listener's view point, and so on. Likewise, upper ring 304 can have K channels U1, U2 . . . Uk each having a respective azimuth angle.

A panner, e.g., the ISF panner 106 of FIG. 2, can place an audio object at an arbitrary azimuth angle from a listener. In particular, the ISF channels in each ring are encoded in such a way that they are reconfigurable. For example, the ISF channels M1 through Mn can be decoded via a decode matrix to an arbitrary set of speakers. During encoding, an object analyzer, e.g., the AISF object analyzer 208 of FIG. 2, can warp a ring by changing one or more azimuth angles in the ring. During decoding, an adaptive unwarper unwarps the ring by changing the one or more azimuth angles back. Additional details of the warping and unwarping are described below in reference to FIG. 4.

Figure 4:
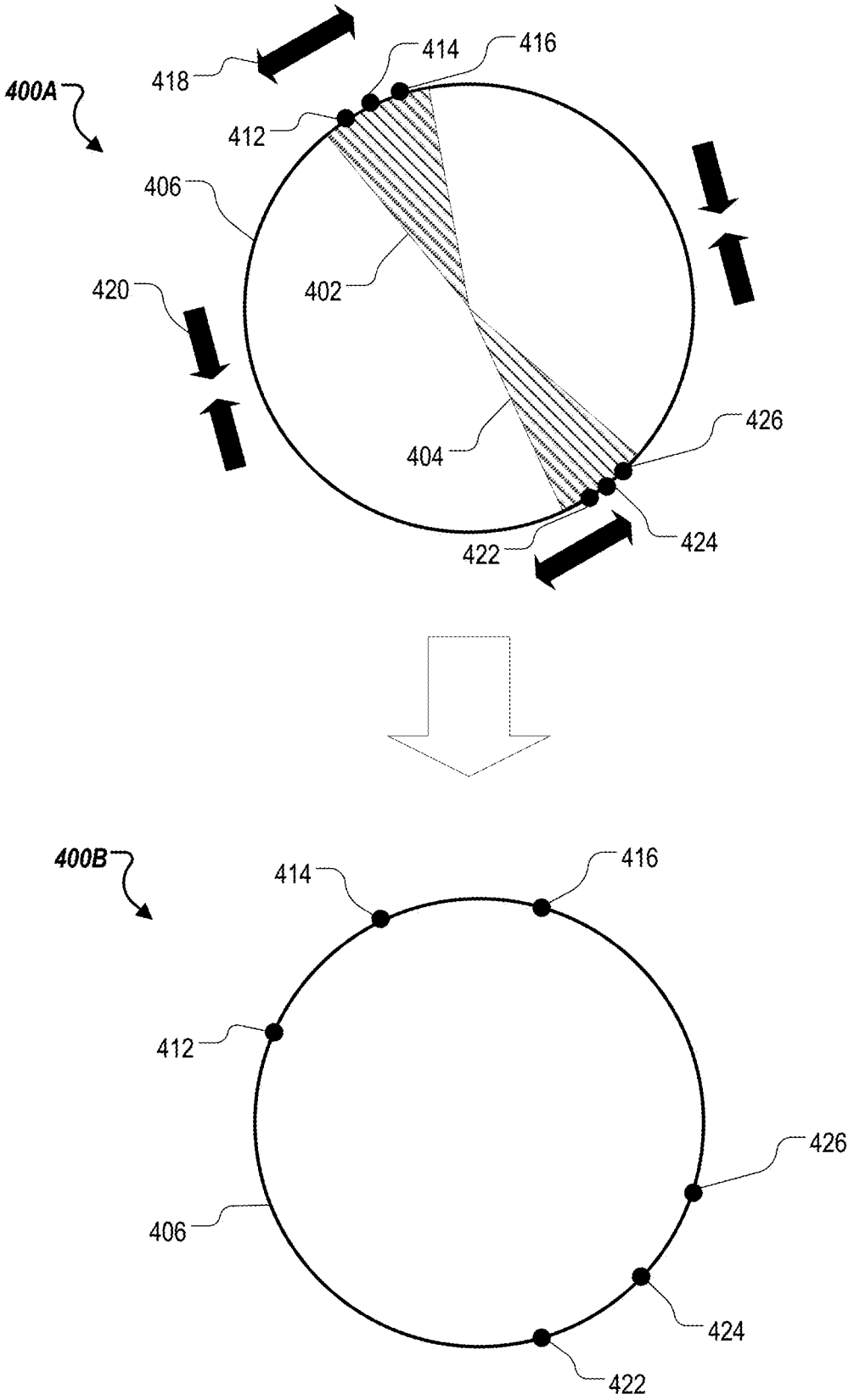
FIG. 4 is a diagram illustrating example warping of object locations in an ISF ring.

FIG. 4 is a diagram illustrating example warping of object locations in an ISF ring. The ring can be, for example, middle ring 306 of FIG. 3. An object analyzer, e.g., the AISF object analyzer 208 of FIG. 2, can measure audio object data and position information to determine that, at time t, as represented by 400A, a measure of audio signal amplitude is higher in regions 402 and 404 than in other regions of ring 406. The higher amplitude can be caused by a concentration of audio objects, e.g., objects 412, 414 and 416 in region 402, and objects 422, 424 and 426 in region 404.

In response, the object analyzer can warp ring 306 by expanding regions 402 and 404. For example, the object analyzer can determine angular distances between objects 412, 414 and 416, and increase (418) the distances. The object analyzer can reduce (420) the other regions where audio signal amplitude is relatively low. In various implementations, the amount of increase and decrease can vary. For example, the amount of increase can be a function of the differences between the "high" measure of amplitude level and the "low" measure of amplitude level, where greater differences correspond to higher amount of increase or decrease.

Likewise, the object analyzer can determine the amount of increase in angular distances between objects 422, 424 and 426. The object analyzer can encode the amounts of increases as weights in a weight vector, and provide the weight vector to a panner. The panner can then encode the positions of objects 412, 414, 416, 422, 424 and 426 as represented in 400B into ISF audio channels. As a result, the panner can increase the number of ISF audio channels that span regions 402 and 404 where objects are concentrated. For example, in a ISF configuration where middle ring 306 includes nine virtual speakers (hence nine audio channels), a conventional panner will locate objects 412, 414 and 416 between the center azimuths of two ISF audio channels. After the warping, a panner can use the warping coefficient to spatially increase the distances between the objects. As a result, the panner can spread objects 412, 414 and 416 over the center azimuths of four ISF channels. The increase in number of channels can improve spatial resolution. At a decoder device, the warp of 400B can be removed, and the objects 412, 414, 416, 422, 424 and 426 restored to their original positions as represented in 400A.

AISF System Components

Figure 5:
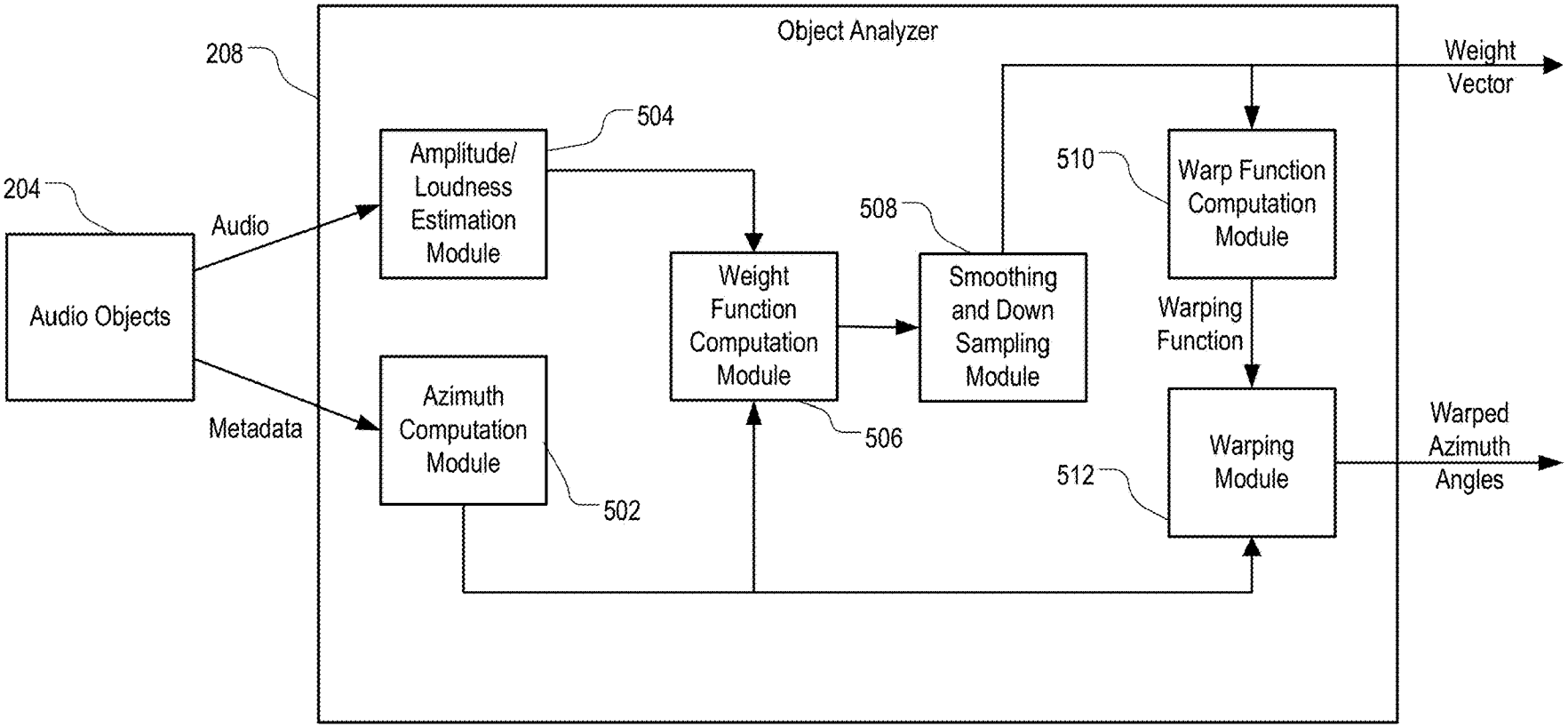
FIG. 5 is a block diagram illustrating an example AISF object analyzer.

FIG. 5 is a block diagram illustrating an example AISF object analyzer 208. The AISF object analyzer 208 includes an azimuth computation module 502. The azimuth computation module 502 is a component device of the AISF object analyzer 208 configured to determine a respective azimuth angle of each audio object 204 using metadata of the audio objects 204. The metadata can include time-varying position information in either Cartesian or Spherical coordinates. In some implementations, the azimuth computation module 502 can use other information in the metadata to determine the azimuth angle $az_{obj}$ of an audio object obj. The information can include factors such as, for example, object extent or size, object divergence, whether an object is locked to a particular audio channel or zone in coordinate space, playback screen size, and listener position, among others.

The AISF object analyzer 208 includes an amplitude/loudness estimation module 504. The amplitude/loudness estimation module 504 is a component device of the AISF object analyzer 208 configured to determine a time-varying estimate of signal amplitude or loudness of each audio signal in each audio object 204. The amplitude/loudness estimation module 504 can determine the estimate using a leaky integration of the incoming signal, e.g., by using Equation (1) below.

$$p[n]=(1-\alpha)x[n]^2+\alpha p[n-1], \tag{1}$$

where p[n] is a power estimate of audio signal x[n], n is a sample index, indicating discrete time, x[n] is the discrete-time audio signal. Equation (1) can represent a one-pole low-pass filter, also known as a leaky integrator, action on the squared signal $x[n]^2$. $\alpha$ is a filter coefficient, and can take values in the range of [0, 1]. A larger $\alpha$ moves cutoff frequency of the low-pass filter down towards 0 (zero) Hertz.

In some implementations, the amplitude/loudness estimation module 504 can determine the estimate using a loudness estimation procedure that accounts for psychoacoustic phenomena, such as the frequency-dependence and level-dependence of loudness.

The AISF object analyzer 208 includes a weight function computation module 506. The weight function computation module 506 is a component device of the AISF object analyzer 208 configured to determine a time-varying weight function w(az, n], where n is sample index of discrete time. The weight function computation module 506 combines the estimates of signal amplitude or loudness of each object's audio signal to assign a weight to each object's azimuth angle az, and interpolates the weights across the entire azimuth interval, e.g., [0, 360) degrees, to determine the time-varying weight function w(az, n]. The interpolation can be linear interpolation. The time-varying weight function w(az, n] assigns a positive weight, which is strictly greater than zero, to any given value of az.

The time-varying weight function w(az, n] may be transmitted to an AISF decoder along with ISF audio. Accordingly, the AISF object analyzer 208 provides the function in a compact manner. The AISF object analyzer 208 includes a smoothing and down-sampling module 508. The smoothing and down-sampling module 508 is a component device of the AISF object analyzer 208 configured to smooth the weight function w(az, n], e.g., by a low-pass filter. The smoothing and down-sampling module 508 down-samples the function w(az, n], e.g., uniformly or non-uniformly, to yield a weight vector. The weight vector can be a two-column vector containing a list of azimuth angles on the first column and corresponding positive weights on the second column.

As a secondary output, the AISF object analyzer 208 generates a set of warped azimuth angles for the audio objects 204. To compute the warped azimuth angles, the AISF object analyzer 208 converts the weight vector into a warping function wrp using a warp function computation module 510. Additional details of converting the weight vector into the warping function wrp are described below in reference to FIG. 6.

Once the warping function wrp is computed, the AISF object analyzer 208 takes the original object azimuth angles $az_{obj}$ as computed by the azimuth computation module 502, and warps the original object azimuths $az_{obj}$ using a warping module 512. The warping module 512 is a component device of the AISF object analyzer 208 configured to apply the warping function wrp to the original object azimuths $az_{obj}$ to obtain warped object azimuth angle $azw_{obj}$ using Equation (2) below.

$$azw_{obj}=wrp(az_{obj}), \tag{2}$$

where $azw_{obj}$ is the warped object azimuth angle of an audio object obj, azimuths $az_{obj}$ is the original object azimuths angle of the audio object obj, and wrp is the warping function.

Figure 6:
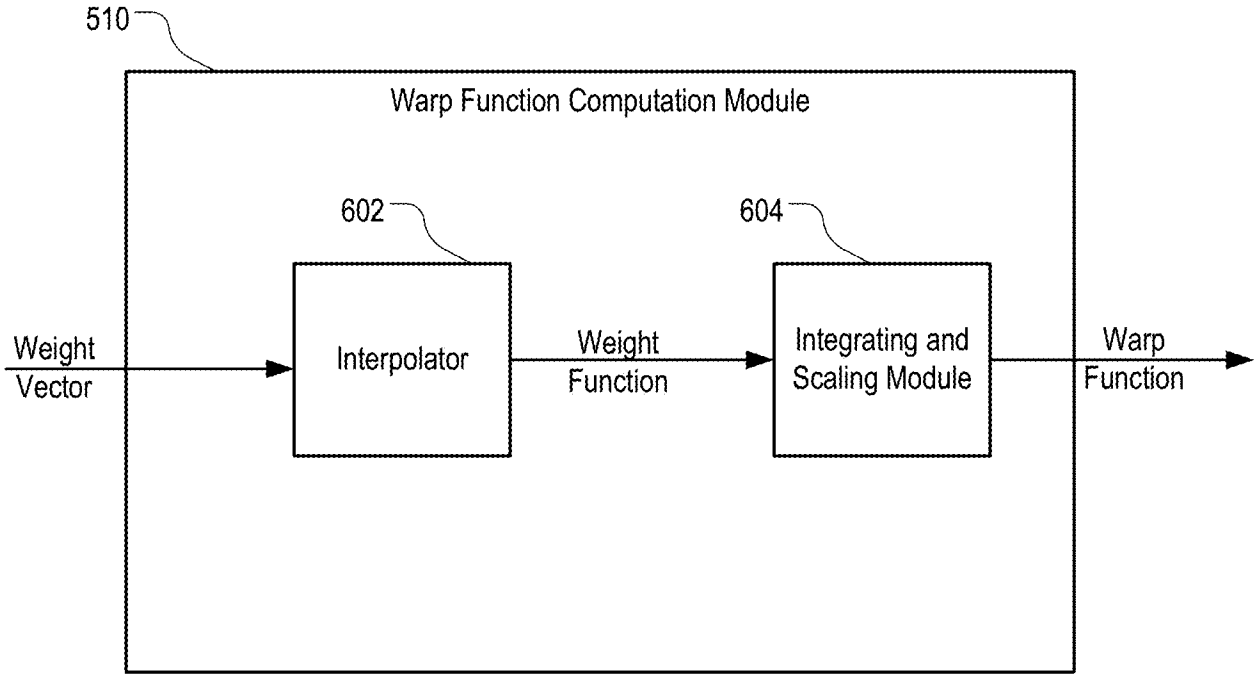
FIG. 6 is a block diagram illustrating an example warp function computation module.

FIG. 6 is a block diagram illustrating an example warp function computation module 510. The warp function computation module 510 includes interpolator 602 and integrating and scaling module 604. Each of the interpolator 602 and integrating and scaling module 604 can be a component device of the warp function computation module 510 including one or more processors.

The interpolator 602 is configured to interpolate a weight vector, e.g., linearly, to obtain a smooth weight function over an entire interval of azimuth, e.g., 360 degrees. The output of the interpolator 602 is a weight function. For example, the interpolator 602 receives an example weight vector v, as shown below in Equation (3).

$$v=\begin{bmatrix} 0 & 1 \\ 90 & 1 \\ 120 & 6 \\ 150 & 1 \\ 300 & 1 \\ 330 & 3 \end{bmatrix}, \tag{3}$$

where the left column includes azimuth angles in degrees, and the right column includes respective weights on the corresponding azimuth angles. The interpolator 602 interpolates this weight vector v to generate an interpolated weight function over the entire interval. An example of an interpolated weight function is described below in reference to FIG. 7.

The integrating and scaling module 604 integrates the weight function to obtain an integrated function $\widehat{wrp}$ (az). An example of the integrated function $\widehat{wrp}$ (az) is described below in reference to FIG. 8. The integrating and scaling module 604 can then scale this function and re-center the function at 0° using Equations (4) and (5) below to obtain the scaled warping function wrp(az).

$$\widetilde{wrp} = \widehat{wrp} / (\max(\widehat{wrp}) - \min(\widehat{wrp})) * 360 \quad (4)$$

$$wrp = \widetilde{wrp} - \min(\widetilde{wrp}) \quad (5)$$

where $\widetilde{wrp}$ is a scaled function, and wrp is the resulting warp function, centered.

Figure 7:
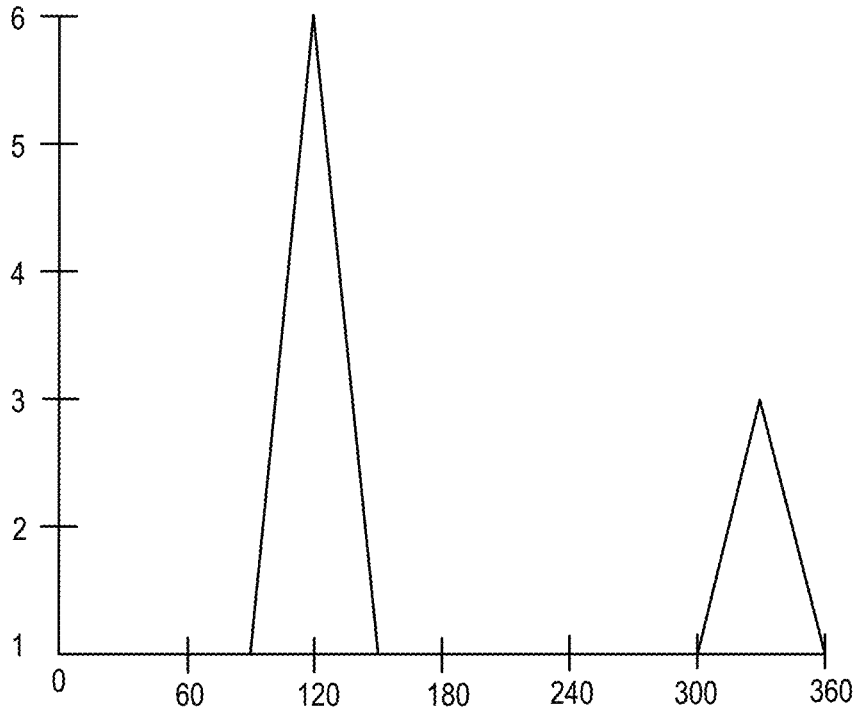
FIG. 7 is a diagram illustrating an example interpolated weight function.

FIG. 7 is a diagram illustrating an example interpolated weight function. The interpolated weight function corresponds to the example weight factor of Equation (3). The horizontal axis corresponds to azimuth angles, as measured in degrees. The vertical axis corresponds to interpolated weights.

Figure 8:
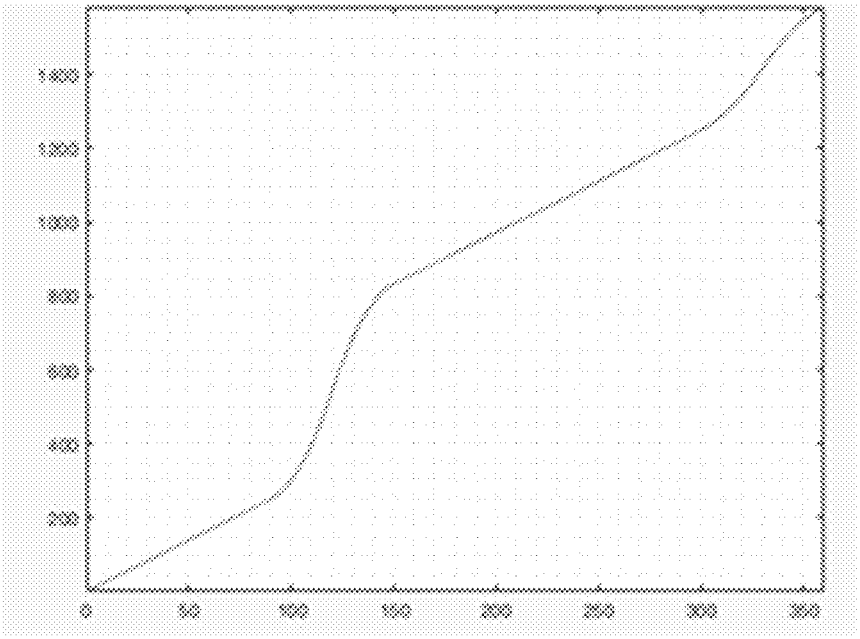
FIG. 8 is a diagram illustrating an example integrated weight function.

FIG. 8 is illustrating an example integrated weight function $\widehat{wrp}$ (az). The integrated weight function $\widehat{wrp}$ (az) corresponds to the interpolated weight function of FIG. 7. The horizontal axis corresponds to azimuth angles, as measured in degrees. The vertical axis corresponds to integrated weights. The integrated weight function $\widehat{wrp}$ (az), upon scaling and re-centering, results in a warp function wrp as described above.

Figure 9:
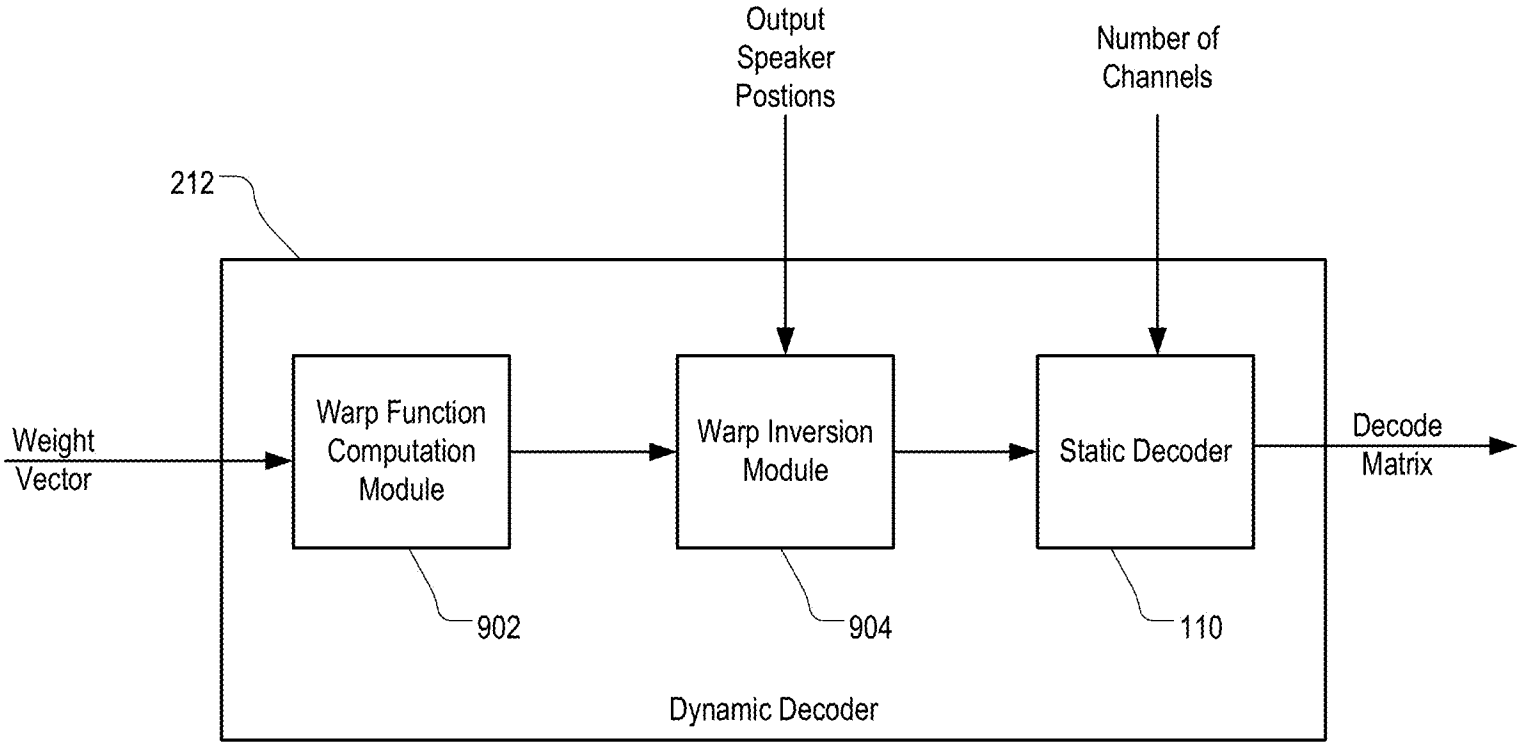
FIG. 9 is a block diagram illustrating an example AISF panner.

FIG. 9 is a block diagram an example dynamic decoder 212. The dynamic decoder 212 is a device configured to compute a time-varying decode matrix that is used by the AISF decoder, e.g., the AISF decoder device 210 of FIG. 2, to convert a set of ISF channel signals generated by an AISF encoder, e.g., the AISF encoder device 202 of FIG. 2, or an AISF downmixer to loudspeaker audio signals.

The dynamic decoder 212 includes a warp function computation module 902. The warp function computation module 902 is a component device of the dynamic decoder 212 that has the same functionality as the warp function computation module 510 described in reference to FIG. 5. The warp function computation module 902 is configured to receive a weight vector and compute a smooth warp function wrp.

The dynamic decoder 212 includes a warp inversion module 904. The warp inversion module 904 is a component device of the dynamic decoder 212 configured to determine an inverse of the warp function $wrp^{-1}$. The warp inversion module 904 also receives output speaker positions. The output speaker positions can include loudspeaker azimuth angles $az_{spk}$. The warp inversion module 904 applies the inverse of the warp function $wrp^{-1}$ to the loudspeaker azimuth angles $az_{spk}$ to determine warped loudspeaker azimuth angles using Equation (6) below.

$$azw_{spk} = wrp^{-1}(az_{spk}), \quad (6)$$

where $azw_{spk}$ are the warped loudspeaker azimuths angles. The warp inversion module 904 feeds the warped loudspeaker azimuth angles to a static decoder 110. The static decoder 110 is a component device of the dynamic decoder 212 configured to determine a decoder matrix based on the warped loudspeaker azimuths and a number of channels. An AISF decoder can multiply ISF audio channels by the decoder matrix to generate speaker output.

Figure 10:
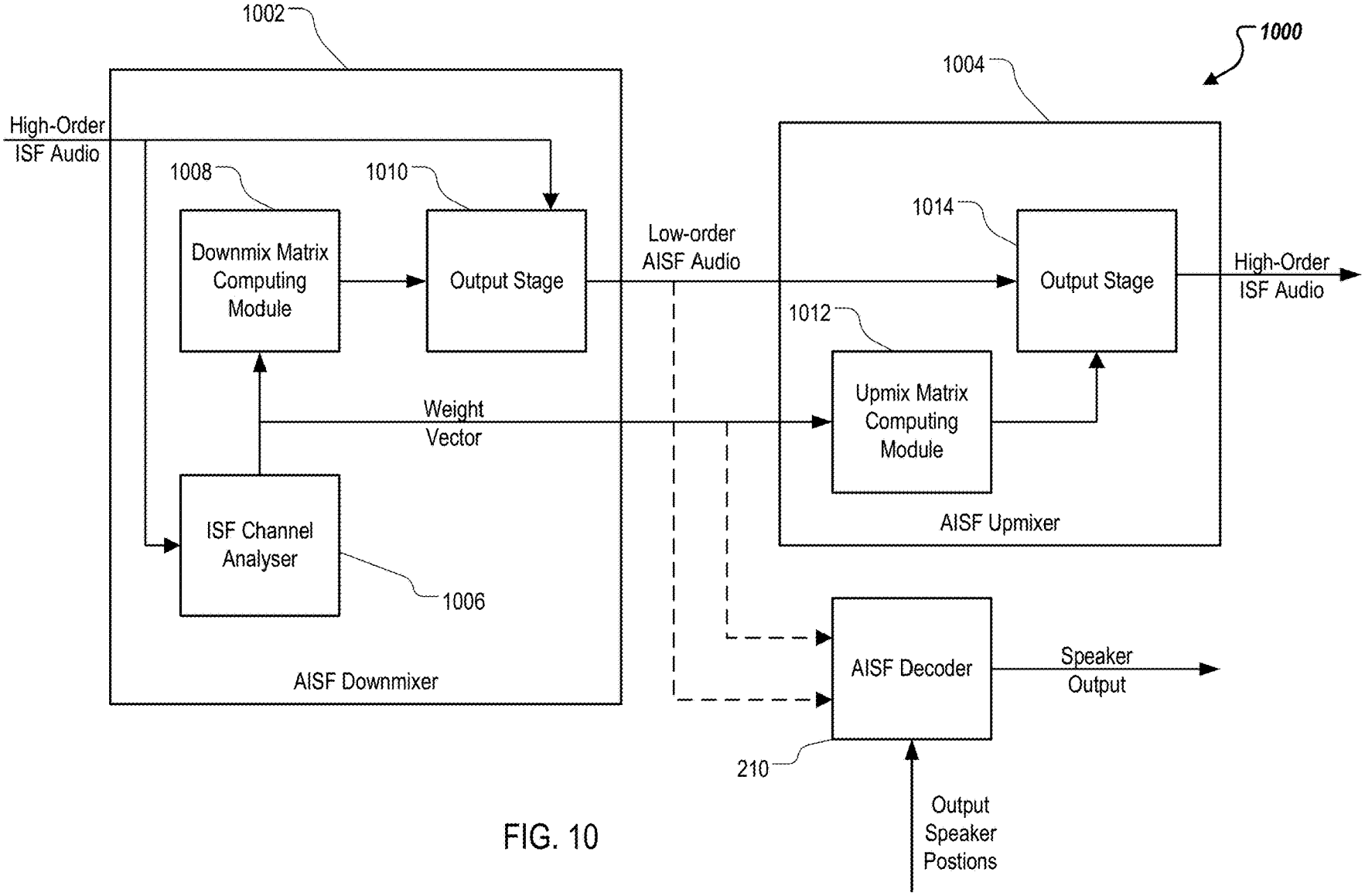
FIG. 10 is a block diagram illustrating an example AISF downmixing/upmixing system.

FIG. 10 is a block diagram illustrating an example AISF downmixing/upmixing system 1000. The AISF downmixing/upmixing system 1000 includes an example AISF downmixer device 1002 and an example AISF upmixer device 1004. The AISF downmixing/upmixing system 1000 can achieve audio quality that is similar to the audio quality in the conventional ISF audio system using fewer channels by downmixing and upmixing.

The AISF downmixer device 1002 adaptively warps and downmixes incoming high-order, e.g., M-channel, ISF audio signals into low-order, e.g., N-channel, ISF audio signals having fewer channels, where M is greater than N.

The AISF downmixer device 1002 computes the low-order, N-channel AISF audio signals L from the high-order, M-channel ISF audio signals H using Equation (7) below.

$$L = DH, \quad (7)$$

where D is an N by M downmix matrix.

The ISF channel analyzer 1006 is configured to receive the M-channel ISF audio signals, and generate a weight vector based on the M-channel ISF audio signals. The ISF channel analyzer 1006 provides the weight vector to the AISF upmixer device 1004. Additional details on the ISF channel analyzer 1006 are described below in reference to FIG. 11. The AISF downmixer device 1002 includes a downmix matrix computing module 1008. The downmix matrix computing module 1008 is a component device of the AISF downmixer device 1002 configured to generate the downmix matrix D based on the weight vector generated by the ISF channel analyzer 1006.

The downmix matrix computing module 1008 provides the downmix matrix D to an output stage 1010 of the AISF downmixer device 1002. The output stage 1010 can include a multiplier that multiplies the downmix matrix D to the M-channel ISF audio signals H to generate the low-order, N-channel AISF audio signals L according to Equation (7) above.

The AISF downmixer device 1002 transmits the N-channel AISF audio signals L, along with the time-varying weight vector, to the AISF upmixer device 1004. The AISF upmixer device 1004 includes an upmix matrix computing module 1012, which is configured to generate an upmix matrix from the weight vector. AISF upmixer device 1004 includes an output stage 1014. The output stage 1014 includes a multiplier that multiplies the upmix matrix to the N-channel AISF audio signals L to reconstruct an approximation of the original high-order M-channel ISF audio signals H. This high-order approximation can then travel through a conventional ISF signal chain and eventually be decoded by a conventional ISF decoder.

Alternatively or in addition, an AISF decoder device 210 can directly decode the N-channel AISF audio signals L.

To compute the downmix matrix that converts high-order ISF (N channels) to low-order AISF (M channels), given a weight vector v, the downmix matrix computing module 1008 computes a warping function wrp using the techniques described in reference to FIG. 6. The downmix matrix computing module 1008 then creates a P-point vector $az_{grid}$ that uniformly samples the azimuth interval, e.g. [0, 360) degrees. The downmix matrix computing module 1008 invokes a conventional low-order ISF panner with warped azimuth angles $azw_{grid}$. The downmix matrix computing module 1008 computes the warped azimuth angles using Equation (8) below.

$$azw_{grid} = wrp(az_{grid}) \quad (8)$$

Invoking the ISF panner constructs a matrix O having M rows and P columns. This matrix contains the warped low-order ISF channel panning curves. Likewise, a conventional high-order ISF panner is invoked with azimuths $az_{grid}$ to construct an N by P matrix I containing the unwarped high-order ISF panning curves.

The downmix matrix computing module 1008 computes the N by M downmix matrix D by determining a least-squares solution to the system of equations DI=O. Likewise, the upmix matrix computing module 1012 can compute an upmix matrix by computing a Moore-Penrose pseudoinverse of D.

Figure 11:
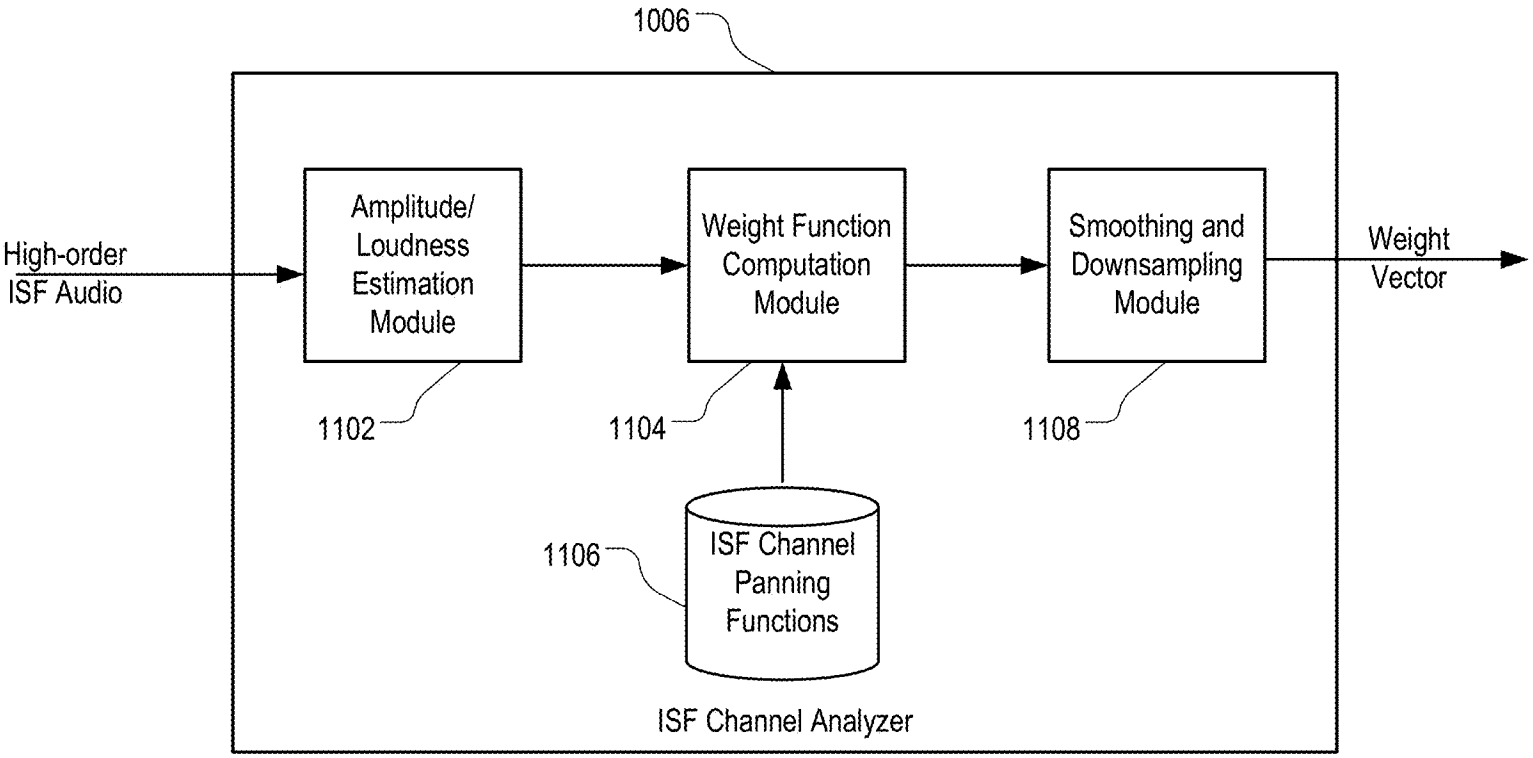
FIG. 11 is a block diagram an example AISF channel analyzer.

FIG. 11 is a block diagram an example AISF channel analyzer 1006. The AISF channel analyzer 1006 is functionally analogous to the AISF object analyzer 208 of FIG. 5. The AISF channel analyzer 1006 computes a weight vector having the same form as the weight vector generated by the AISF object analyzer 208. Whereas the AISF object analyzer 208 takes audio objects with positional metadata as input, the AISF channel analyzer 1006 takes a set of ISF channels as input and does not require metadata.

The AISF channel analyzer 1006 includes an amplitude/loudness estimation module 1102. The amplitude/loudness estimation module 1102 can be a device having the same functionality of the amplitude/loudness estimation module 504 of FIG. 5. The AISF channel analyzer 1006 includes a weight function computation module 1104. The weight function computation module 1104 can be a device having the same functionality of the weight function computation module 506 of FIG. 5. In the ISF audio signals, as shown in FIG. 3, the relationship between an azimuth angle and an ISF channel is implicit. Accordingly, the weight function computation module 1104 can compute the weight function using pre-computed ISF channel panning functions 1106.

The ISF channel panning functions 1006 can be represented as ø(az,ch], where az is an azimuth angle and ch is the ISF channel number. The time-varying amplitude estimate for each channel can be represented as p[n,ch]. The weight function computation module 1104 can compute the weight function w(az,n] using Equation (9) below.

$$w(az,n]=\Sigma_{ch}ø(az,ch]p[n,ch], \quad (9)$$

where w(az, n] is the weight function, defined as a sum of the channel panning functions ø(az,ch] across ISF channels. Each ISF audio channel is weighted by a corresponding channel amplitude estimate.

The AISF channel analyzer 1006 includes a smoothing and downsampling module 1108. The smoothing and downsampling module 1108 is a component device of the AISF channel analyzer 1006 configured to perform operations of smoothing and downsampling as described in reference to the smoothing and down-sampling module 508 described in reference to FIG. 5. The smoothing and downsampling module 1108 generates a weight factor based on the weight function w(az,n] and provides the weight factor to one or more of a downmix matrix computing module of an AISF downmixer device, an upmix matrix computing module of an AISF upmixer device, or an AISF decoder device.

Example Procedures

Figure 12:
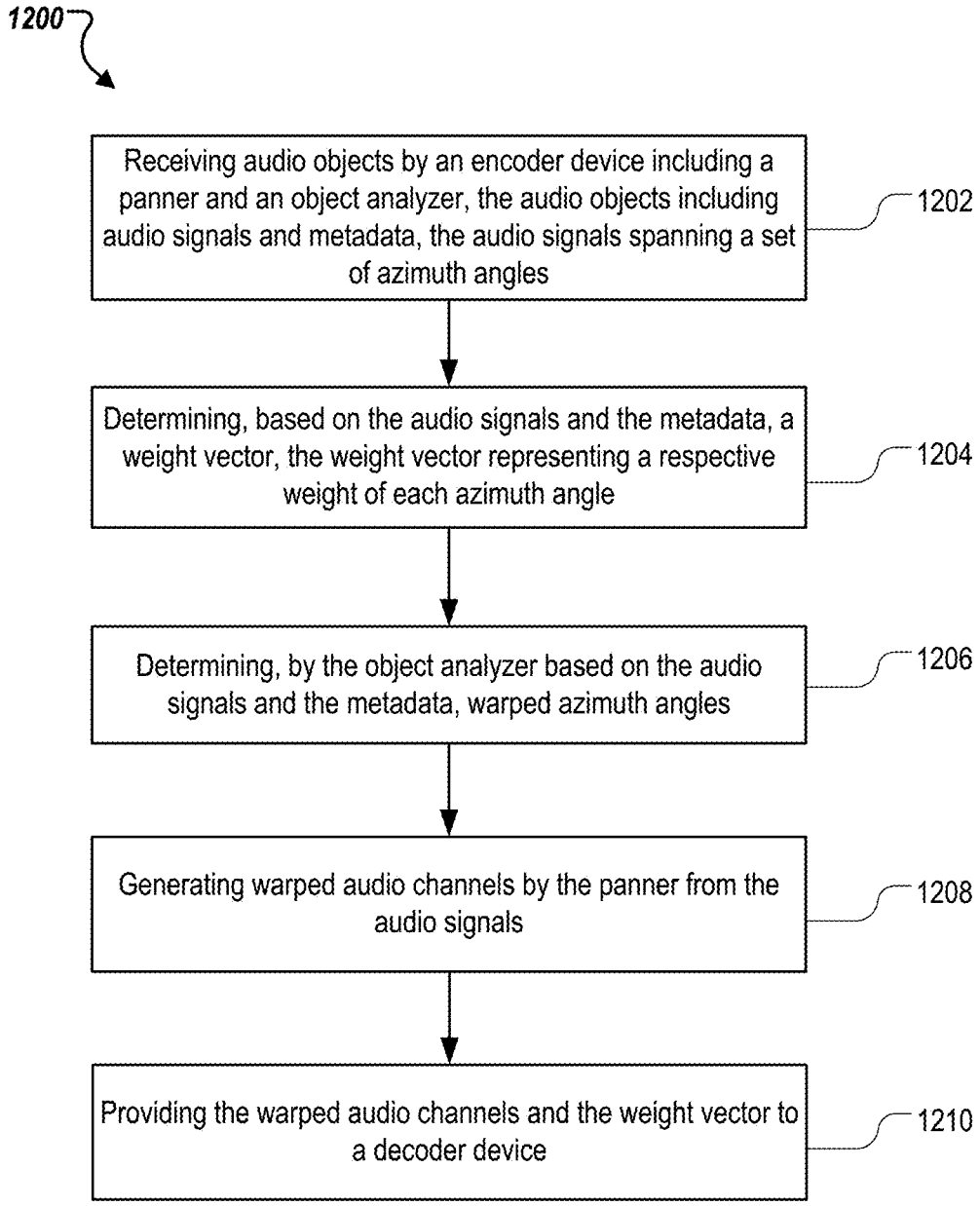
FIG. 12 is a flowchart of an example process of encoding audio signals using AISF techniques.

FIG. 12 is a flowchart of an example process 1200 of encoding audio signals using AISF techniques. The process 1200 can be performed by an encoder device, e.g., the AISF encoder device 202 of FIG. 2, that includes a panner and an object analyzer.

The encoder device receives (1202) audio objects. The audio objects include audio signals and metadata. The audio signals span a set of azimuth angles. The azimuth angles can be represented by, or derived from the metadata.

The object analyzer of encoder device determines (1204), based on the audio signals and the metadata, a weight vector. The weight vector represents a respective weight of each azimuth angle. The weight can correspond to amplitude level corresponding to the azimuth angle. Determining the weight vector can include the following operations. The object analyzer determines a respective time-varying estimate of signal amplitude for each audio signal. The object analyzer weights a respective original azimuth angle of each audio object based on the time-varying estimates. The object analyzer generates a time-varying weight function by interpolating the weighted respective original azimuth angles across an entire azimuth interval. The object analyzer determines the weight vector by smoothing and downsampling the weight function. The weigh vector is time-varying.

The object analyzer of encoder device determines (1206), based on the audio signals and the metadata, warped azimuth angles. The warped azimuth angles are varied based on weights in the weight vector. For example, the warped azimuth angles can increase angular distances between azimuth angles having higher weight and decrease angular distances between azimuth angles having lower weight. The warped azimuth angles are time-varying. Determining the warped azimuth angles can include the following operations. The object analyzer generates a weight function by interpolating the weight vector. The object analyzer generates a warp function by integrating the weight function. The object analyzer determines the warped azimuth angles by applying the warp function to original azimuth angles of the audio objects.

The panner, e.g., the ISF panner 106 of FIG. 2, of the encoder device generates (1208) warped audio channels from the audio signals. The panner alters spatial positions of the audio signals according to the warped azimuth angles.

The encoder device provides (1210) the warped audio channels and the weight vector to a decoder device, e.g., the AISF decoder device 210 of FIG. 2, for unwarping the audio channels based on the weight vector to output to a speaker system. The speaker system can include multiple loudspeakers or one or more headphone devices.

The decoder device can include an output stage and a dynamic decoder. The output stage can receive warped audio channels from the ISF panner. The warped audio channels include audio signals having warped azimuth angles that have been increased or decreased from original azimuth angles.

The dynamic decoder of the decoder device can receive a weight vector. The dynamic decoder can determine, based at least in part on the weight vector, and based on speaker position information received by the dynamic decoder, an inverse warping function $wrp^{-1}$. The inverse warping function varies angular distances between the warped azimuth angles based at least in part on weights in the weight vector. For example, the inverse warping function can decrease angular distances between warped azimuth angles having higher weights and increase angular distances between azimuth angles having lower weights.

The dynamic decoder determines warped speaker positions based on the inverse warping function. The dynamic decoder generates, using a static decoder, a decode matrix based on the warped speaker position. The dynamic decoder provides the decode matrix to the output stage. The output stage, in turn, generates speaker signals based on the warped audio channels and the decode matrix for output to a speaker system.

Figure 13:
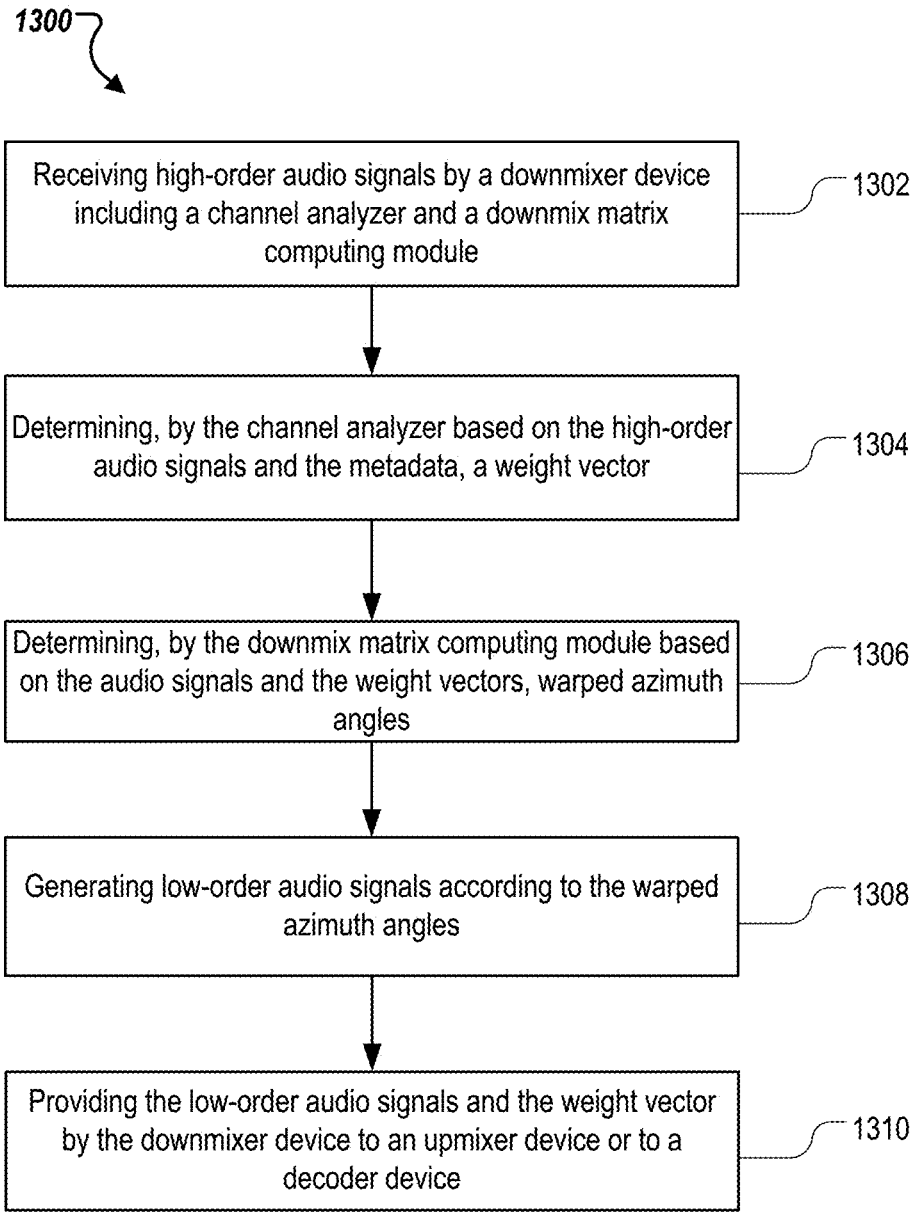
FIG. 13 is a flowchart of an example process of downmixing ISF signals using AISF techniques.

FIG. 13 is a flowchart of an example process 1300 of downmixing ISF signals using AISF techniques. The process 1300 can be performed by a downmixer device, e.g., the AISF downmixer device 1002 of FIG. 10. The downmixer device includes a channel analyzer and a downmix matrix computing module.

The downmixer device receives (1302) high-order audio signals. The high-order audio signals are in ISF format. The high-order audio signals have a first number (M) of audio channels, each channel corresponding to a respective azimuth angle.

The channel analyzer of the downmixer device determines (1304), based on the high-order audio signals, a weight vector. The weight vector representing a respective weight of each azimuth angle. Determining the weight vector is based on amplitudes of the audio signals and pre-computed channel panning functions.

The downmix matrix computing module of the downmixer device determines (1306), based on the audio signals and the weight vectors, warped azimuth angles. The warped azimuth angles increase angular distances between azimuth angles having higher weight and decrease angular distances between azimuth angles having lower weight. Determining the warped azimuth angles can include the following operations. The downmix matrix computing module generates a weight function by interpolating the weight vector. The downmix matrix computing module generates a warp function by integrating the weight function. The downmix matrix computing module determines the warped azimuth angles by applying the warp function to original azimuth angles of the audio signals.

The downmixer device generates (1308) low-order audio signals according to the warped azimuth angles. The low-order audio signals have a second number (N) of audio channels. The second number N is smaller than the first number M.

The downmixer device provides (1310) the low-order audio signals and the weight vector to an upmixer device, e.g., the AISF upmixer device 1004 of FIG. 10, or to a decoder device, e.g., the AISF decoder device 210 of FIG. 10, for upmixing and unwarping the audio channels based on the weight vector to output to a speaker system.

Example System Architecture

Figure 14:
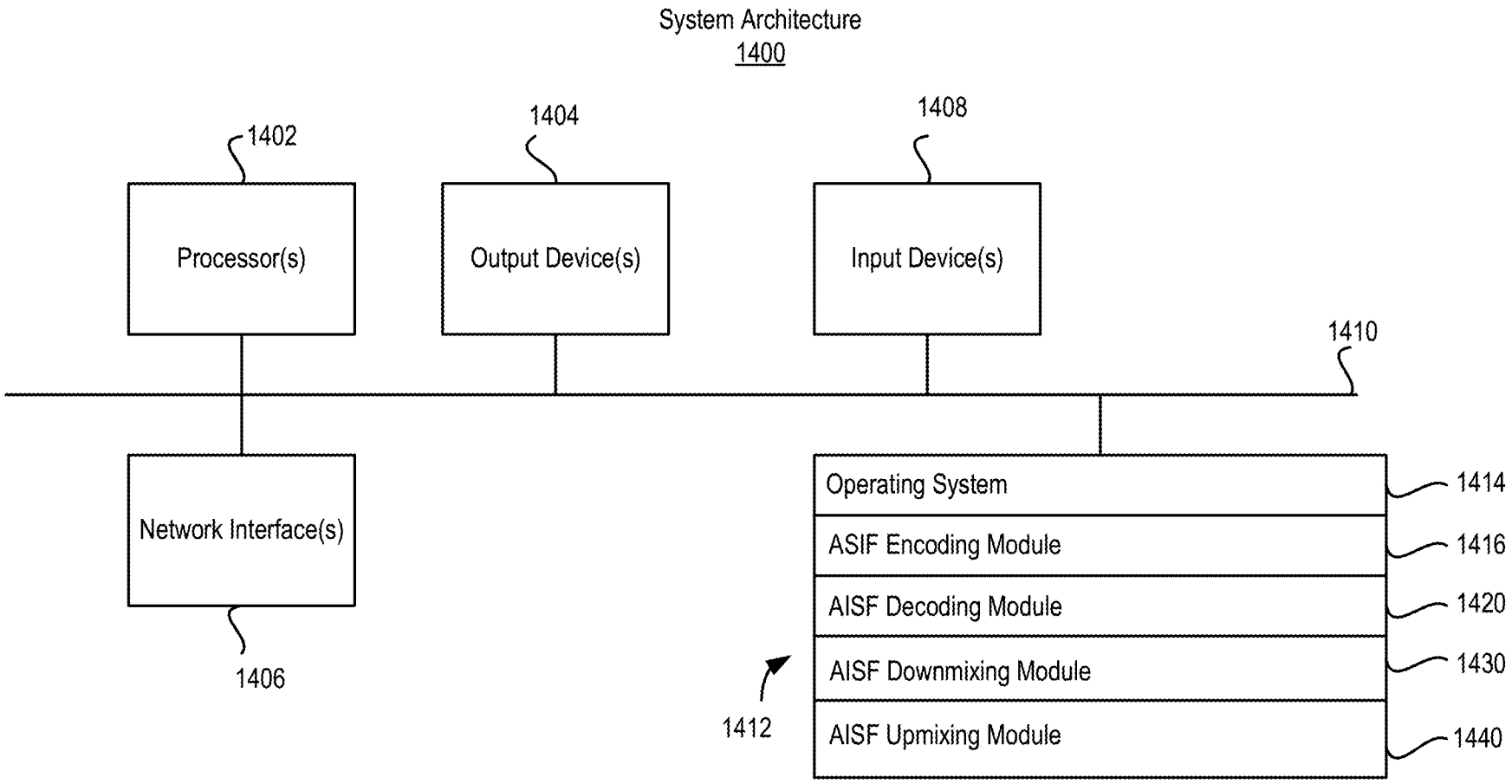
FIG. 14 is a block diagram of a system architecture for an example system implementing AISF techniques.

FIG. 14 is a block diagram of a system architecture for an example audio processing system. Other architectures are possible, including architectures with more or fewer components. In some implementations, architecture 1400 includes one or more processors 1402 (e.g., dual-core Intel® Xeon® Processors), one or more output devices 1404 (e.g., LCD), one or more network interfaces 1406, one or more input devices 1408 (e.g., mouse, keyboard, touch-sensitive display) and one or more computer-readable mediums 1412 (e.g., RAM, ROM, SDRAM, hard disk, optical disk, flash memory, etc.). These components can exchange communications and data over one or more communication channels 1410 (e.g., buses), which can utilize various hardware and software for facilitating the transfer of data and control signals between components.

The term "computer-readable medium" refers to a medium that participates in providing instructions to processor 1402 for execution, including without limitation, non-volatile media (e.g., optical or magnetic disks), volatile media (e.g., memory) and transmission media. Transmission media includes, without limitation, coaxial cables, copper wire and fiber optics.

Computer-readable medium 1412 can further include operating system 1414 (e.g., a Linux® operating system), AISF encoding module 1416, AISF decoding module 1420, AISF downmixing module 1430 and AISF upmixing module 1440. Operating system 1414 can be multi-user, multiprocessing, multitasking, multithreading, real time, etc. Operating system 1414 performs basic tasks, including but not limited to: recognizing input from and providing output to network interfaces 1406 and/or devices 1408; keeping track and managing files and directories on computer-readable mediums 1412 (e.g., memory or a storage device); controlling peripheral devices; and managing traffic on the one or more communication channels 1410. AISF encoding module 1416 includes computer instructions that, when executed, cause processor 1402 to perform operations of an AISF encoder device, e.g., the AISF encoder device 202 of FIG. 2.

AISF decoding module 1420 can include computer instructions that, when executed, cause processor 1402 to perform operations of an AISF encoder device, e.g., the AISF decoder device 210 of FIG. 2. AISF downmixing module 1430 can include computer instructions that, when executed, cause processor 1402 to perform operations of an AISF downmixer device, e.g., the AISF downmixer device 1002 of FIG. 10. AISF upmixing module 1440 can include computer instructions that, when executed, cause processor 1402 to perform operations of an AISF upmixer device, e.g., the AISF upmixing device 1004 of FIG. 10.

Architecture 1400 can be implemented in a parallel processing or peer-to-peer infrastructure or on a single device with one or more processors. Software can include multiple software components or can be a single body of code.

The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language (e.g., Objective-C, Java), including compiled or interpreted languages, and it can be deployed in any form, including as a stand-alone program or as a module, component, subroutine, a browser-based web application, or other unit suitable for use in a computing environment.

Suitable processors for the execution of a program of instructions include, by way of example, both general and special purpose microprocessors, and the sole processor or one of multiple processors or cores, of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) monitor or a retina display device for displaying information to the user. The computer can have a touch surface input device (e.g., a touch screen) or a keyboard and a pointing device such as a mouse or a trackball by which the user can provide input to the computer. The computer can have a voice input device for receiving voice commands from the user.

The features can be implemented in a computer system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include, e.g., a LAN, a WAN, and the computers and networks forming the Internet.

The computing system can include clients and servers. A client and server are generally remote from each other and typically interact through a communication network. The relationship of client and server arises by virtue of computer programs running on the respective computers and having a client-server relationship to each other. In some embodiments, a server transmits data (e.g., an HTML page) to a client device (e.g., for purposes of displaying data to and receiving user input from a user interacting with the client device). Data generated at the client device (e.g., a result of the user interaction) can be received from the client device at the server.

A system of one or more computers can be configured to perform particular actions by virtue of having software, firmware, hardware, or a combination of them installed on the system that in operation causes or cause the system to perform the actions. One or more computer programs can be configured to perform particular actions by virtue of including instructions that, when executed by data processing apparatus, cause the apparatus to perform the actions.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

A number of implementations of the invention have been described. Nevertheless, it will be understood that various modifications can be made without departing from the spirit and scope of the invention.

What is claimed:

1. A method comprising:

receiving, by an encoder device including a panner and an object analyzer, audio objects including audio signals and metadata, the audio signals spanning a set of azimuth angles;

determining, by the object analyzer based on the audio signals and the metadata, a weight vector, the weight vector representing a respective weight of each azimuth angle;

determining, by the object analyzer based on the audio signals and the metadata, warped azimuth angles, wherein the warped azimuth angles are varied based on weights in the weight vector;

generating warped audio channels by the panner from the audio signals, including altering spatial positions of the audio signals according to the warped azimuth angles; and providing the warped audio channels and the weight vector to a decoder device for unwarping the warped audio channels based on the weight vector to output to a speaker system.

2. The method of claim 1, wherein each weight corresponds to a respective audio signal amplitude at a respective azimuth angle, and the warped azimuth angles and the weigh vector are time-varying.

3. The method of claim 1, wherein determining the weight vector comprises:

determining a respective time-varying estimate of signal amplitude for each audio signal;

weighting a respective original azimuth angle of each audio object based on the time-varying estimates;

generating a time-varying weight function by interpolating the weighted respective original azimuth angles across an entire azimuth interval; and determining the weight vector by smoothing and downsampling the weight function.

4. The method of claim 1, wherein determining the warped azimuth angles comprises:

generating a weight function by interpolating the weight vector;

generating a warp function by integrating the weight function; and determining the warped azimuth angles by applying the warp function to original azimuth angles of the audio objects.

5. The method of claim 1, wherein the warped azimuth angles increase angular distances between azimuth angles having higher weights and decrease angular distances between azimuth angles having lower weights.

6. The method of claim 1, wherein the speaker system comprises a plurality of loudspeakers or one or more headphone device.

7. A method comprising:

receiving, by a decoder device including a dynamic decoder, warped audio channels, the warped audio channels including audio signals having warped azimuth angles that have been increased or decreased from original azimuth angles;

receiving, by the dynamic decoder of the decoder device, a weight vector, the weight vector representing a respective weight of each original or warped azimuth angle;

determining, by the dynamic decoder, an inverse warping function, the inverse warping function varies angular distances between the warped azimuth angles based at least in part on weights in the weight vector;

determining warped speaker positions by the dynamic decoder based on the inverse warping function; and generating, by the dynamic decoder, a decode matrix based on the warped speaker position, the decode matrix operable to unwarp the warped audio channels to restore the original azimuth angles of the audio signals, wherein the decoder device includes one or more processors.

8. The method of claim 7, comprising:

providing the decode matrix by the dynamic decoder to an output stage of the decoder device to unwarp the warped audio channels; and generating, by the output stage, speaker signals based on the warped audio channels and the decode matrix for output to a speaker system.

9. The method of claim 7, wherein the inverse warping function decreases angular distances between warped azimuth angles having higher weights and increases angular distances between azimuth angles having lower weights.

10. The method of claim 7, wherein determining the warped speaker positions is further based on speaker position information received by the dynamic decoder.

11. The method of claim 1, wherein the warped azimuth angles increase angular distances between azimuth angles having higher weights and decrease angular distances between azimuth angles having lower weights.

12. An encoder device comprising:

one or more processors; and a non-transitory computer-readable medium storing instructions that, when executed by the one or more processors, cause the one or more processors to perform the method of claim 1.

13. A non-transitory computer-readable medium storing instructions that, when executed by one or more processors, cause the one or more processors to perform the method of claim 1.

14. A decoder device comprising:

one or more processors; and a non-transitory computer-readable medium storing instructions that, when executed by the one or more processors, cause the one or more processors to perform the method of claim 7.

15. A non-transitory computer-readable medium storing instructions that, when executed by one or more processors, cause the one or more processors to perform the method of claim 7.

* * * * *